US006198058B1

(12) United States Patent
Graninger et al.

(10) Patent No.: US 6,198,058 B1
(45) Date of Patent: Mar. 6, 2001

(54) SWITCH CONTACT MECHANISM

(75) Inventors: Frank J. Graninger, Wind Lake; Richard M. Green, Germantown, both of WI (US)

(73) Assignee: Rockwell Technologies, LLC, Thousand Oaks, CA (US)

( * ) Notice: Subject to any disclaimer, the term of this patent is extended or adjusted under 35 U.S.C. 154(b) by 0 days.

(21) Appl. No.: 09/406,563

(22) Filed: Sep. 27, 1999

(51) Int. Cl.[7] ..... H01H 9/24

(52) U.S. Cl. ..... 200/50.02; 200/43.07; 200/16 R; 200/341

(58) Field of Search ..... 200/1 R, 1 B, 200/16 R–16 C, 17 R, 43.01, 43.04, 43.07, 50.01, 50.02, 520, 329, 307, 341, 50.06

(56) References Cited

U.S. PATENT DOCUMENTS 3,514,554 * 5/1970 Boysen ..... 200/16
4,029,924 * 6/1977 Frank et al. ..... 200/307
4,282,414 * 8/1981 Johnston et al. ..... 200/160
4,306,123 * 12/1981 Taylor ..... 200/16 A
4,315,123 * 2/1982 Fujita et al. ..... 200/307

* cited by examiner

*Primary Examiner*—Michael Friedhofer
(74) *Attorney, Agent, or Firm*—Adam J. Forman; John J. Horn; William R. Walbrun

(57) ABSTRACT

A switch assembly is provided that comprises a switch having a normally open contact and a normally closed contact which is electrically connected to the normally open contact and which is located either within the same housing as the normally open contact or a separate housing. The housing(s) may be mounted onto a latch assembly which, in turn, is mounted onto a switch operator, thereby closing the normally open contact. If the latch assembly becomes mechanically disengaged from the switch operator, thereby rendering the normally closed contact non-operational, the normally open contact will open, thereby opening the circuit to a machine performing a controlled function. The user, noticing the stoppage of operation, will then be alerted of a malfunction within the switch assembly.

22 Claims, 5 Drawing Sheets

SWITCH CONTACT MECHANISM

BACKGROUND OF THE INVENTION

1. Field of the Invention

The present invention relates to switch assemblies and, more particularly, relates to a method and apparatus for monitoring a contact in a switch assembly.

2. Discussion of the Related Art

Electrical switches, such as pushbuttons or rotary switches used for the control of industrial equipment, are typically mounted onto a front panel of a cabinet so that the manipulated portion of the switch (termed the "operator") projects out from and is accessible at the front of the cabinet.

For a pushbutton switch, a hole may be punched in the cabinet of sufficient diameter to accommodate the pushbutton and a surrounding threaded shaft. The shaft and pushbutton are inserted through the hole, and a threaded retaining nut is placed over the shaft and tightened to securely affix the switch to the panel. The panel is thus sandwiched between the switch body and the retaining nut.

The end of the switch operator protruding inside of the panel may be snapped or otherwise mounted onto one side of a latch assembly, and a contact block or a plurality of contact blocks are mounted onto the other side of the latch assembly. The contact blocks are electrically connected to the circuit or circuits that the switch is to control.

Contact blocks typically comprise housings that contain normally open and/or normally closed contacts. A normally open contact may be used, for example, when a user wishes to activate a specified function by actuating the operator, thereby closing the normally open contact. When the operator switch is deactivated, a plunger returns to its normal position, thereby opening the normally open contact and terminating the controlled function.

A normally closed contact may be used when a user wishes to stop an ongoing function. One common example of a normally closed contact is an Emergency Stop (EStop) function which is activated when the user wishes to immediately terminate the controlled function due, e.g. to a malfunction in the process or the development of a situation that may cause damage to the product line or the operating equipment. In this situation, when the switch operator is actuated, the normally closed contact opens and remains open until the operator is returned to its normal state, thereby closing the normally closed contact and resuming the controlled function.

In such systems, the user assumes a risk that the normally closed contact may become mechanically disengaged from the switch operator. Such a situation may occur, for example, if the latch assembly is damaged or not properly mounted onto the switch operator and therefore becomes detached during operation. Alternatively, the contact block may be damaged or improperly mounted. Even though, in these situations, the contact block is mechanically disconnected from the switch operator, the normally closed contact remains closed, thereby permitting the continuous operation of the controlled function. As a result, when the normally closed contact is functioning as an E-Stop, for example, the controlled function will remain in operation even though the contact block is no longer mechanically engaged with the switch operator.

Currently, one known way to ensure an operable state of a normally closed switch is to test it by intermittently activating the switch operator. If, after activation, the controlled function is nonresponsive, then the user will become aware of a problem in the switch assembly and may take corrective measures. However, this method of detection is quite inefficient and results in considerable unnecessary down-time, thereby increasing cost. Furthermore, this method is unreliable as situations may arise that require the activation of an E-Stop that has become non-operational since the last test.

The need has therefore arisen to implement a method and apparatus for detecting when the normally closed contact becomes mechanically disengaged from the switch operator in an efficient and reliable manner.

OBJECTS AND SUMMARY OF THE INVENTION

It is therefore a first object of the present invention to provide a switch assembly having a switch that: 1) monitors a normally closed contact to determine when the contact becomes mechanically disengaged from a switch operator, and 2) permits normal operation of the controlled function.

It is a second object of the invention to permit the switch and normally closed contact to be mounted either within the same housing or in separate housings.

It is a third object of the invention to provide a single switch that is able to monitor a plurality of contacts.

In accordance with a first aspect of the invention, the switch comprises a normally open contact that is electrically connected in series to the normally closed contact to be monitored, and to the function that the switch assembly is to control. When the switch is connected to the switch operator, preferably via a latch assembly in a known manner, the normally open contact is closed, thereby completing the circuit for the controlled function. To perform a specified operation of the function, the switch operator is actuated to open the normally closed contact. If, during operation, the normally closed contact becomes mechanically disengaged from the switch operator, the normally open contact will open, thereby opening the circuit and terminating operation of the controlled function. The user, noticing the stoppage, will then be alerted that a problem exists in the switch assembly and may take corrective action.

In accordance with a second aspect of the invention, the normally open contact and normally closed contact may either reside in the same housing or in separate housings. If both contacts are in the same housing, the switch preferably comprises a column that is disposed within the housing and that comprises a plunger that is permitted to engage a switch operator stem. A contact spring within the column is interposed between the two contacts in the housing and biases each contact towards its closed position. A return spring, disposed within the housing, biases the normally open contact towards its open position and, because it provides a greater force than the contact spring, maintains the normally open contact in its open position. Additionally, the return spring biases the column upwards so that the plunger extends outside the housing to engage the stem.

When the latch assembly is mounted onto the switch operator, the stem depresses the column via the plunger, and the column compresses the return spring. The contact spring then closes the normally open contact, which is now in mechanical communication with the switch operator. When the operator is activated, the column is further depressed and the normally closed contact, also now in mechanical communication with the operator, opens to perform a specified operation to the controlled function. If the housing becomes disconnected from the switch operator, thereby mechanically disengaging the normally closed and normally open contacts from the switch operator, the plunger will return to its normal position, thereby biasing the return spring to open the normally open contact, opening the circuit, and terminating the controlled function. Additionally, if the plunger breaks, the return spring again will bias the column upwards, thereby opening the normally open contact and terminating the controlled function.

Alternatively, the normally open and normally closed contacts could be disposed within separate housings. In the housing containing the normally closed contact, a plunger that is connected to a column and partially disposed within the housing is connected to the switch operator such that the normally closed contact is opened when the switch operator is actuated. A second plunger is partially disposed within the housing containing the normally open contact such that, when the housing is connected to the switch operator, the plunger closes the normally open contact. If the latch assembly becomes mechanically disconnected from the switch operator, the second plunger will also become disconnected, and the normally open contact will return to the open position and open the circuit.

In accordance with a third aspect of the invention, a single switch operator may control a plurality of contacts that work in tandem on a latch assembly that is mounted onto the switch operator. Again, the plurality of contacts may either be all disposed within the same housing or in different housings. If the contacts are in the same housing, a plurality of contact springs are employed in conjunction with stops within the column to actuate each contact. If the contacts are disposed in different housings, the housings are mounted onto the latch assembly. The switch will again operate in the manner described above if it becomes mechanically disengaged from the switch operator.

Other objects, features, and advantages of the present invention will become apparent to those skilled in the art from the following detailed description and the accompanying drawings. It should be understood, however, that the detailed description and specific examples, while indicating preferred embodiments of the present invention, 5 are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

Pursuant to the invention, a switch for monitoring a normally closed contact in a switch assembly is provided. The switch comprises a normally open contact that is electrically connected in series to the normally closed contact to be monitored. The two contacts are then electrically connected in series to the output controlled by the normally closed switch. In one embodiment, the normally open contact and normally closed contact are disposed within a single contact block that is preferably mounted onto a latch assembly that receives a switch operator. The contact block comprises a housing that includes a plunger that is depressed when the housing is mechanically connected to the switch operator. A movable column comprising the plunger actuates a conductive spanner to close the normally open contact, thereby completing the circuit, when the housing is mechanically connected to the operator. A second spanner is actuated by the column to open the normally closed contact when the operator is actuated. When the housing becomes mechanically disengaged from the operator, the plunger returns to its normal position, thereby opening the normally open switch and opening the electrical circuit. In another embodiment, the normally open contact and normally closed contact are disposed within separate housings that are preferably mechanically connected to the switch operator via a latch assembly. A plunger within one housing biases the normally open contact to a closed position when the housing is connected to the switch operator. Therefore, when the latch assembly becomes mechanically disengaged from the switch operator, the housing with the open contact will also become disengaged, thereby opening the normally open contact and terminating the controlled function. Likewise, the circuit will open when the switch operator is actuated, thereby actuating a plunger within a second housing to open the normally closed contact.

Figure 1:
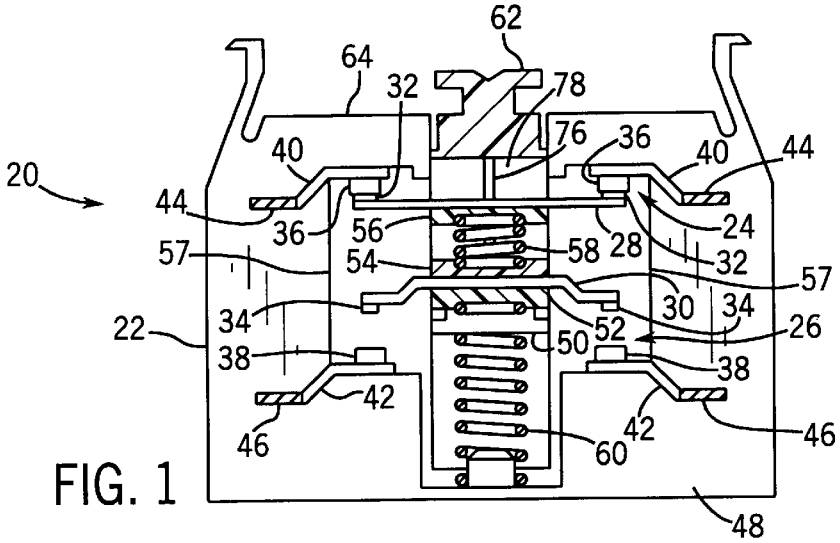
FIG. 1 is a sectional side elevation view of a switch constructed in accordance with a preferred embodiment of the present invention.

Referring to FIG. 1, a switch 20 constructed in accordance with a first embodiment of the invention takes the form of a contact block including a housing 22. A normally closed contact 24 and a normally open contact 26 are disposed within the housing 22 and comprise respective spanners 28, 30 having respective contacts 32, 34 that, when closed, engage respective contacts 36, 38 on leads 40,42 that terminate in respective terminals 44, 46. The spanners, leads, and terminals are formed from a conductive material such that a circuit is completed when both contacts 24, 26 are closed and the terminals are electrically connected in series to a controlled machine (not shown). While the normally open contact 26 is described in accordance with a preferred embodiment of the invention, any connection in a circuit that is normally open and that may be actuated to a closed position during normal operation may be used. Likewise, the normally closed contact 24 could comprise any connection in a circuit that is normally closed that may be actuated to an open position during normal operation.

The leads 40, 42 are inserted into internal slots 57 within the housing 22, and the terminals 44, 46 extend through the housing and are electrically connected in series by one of any known means. The housing 22 includes a movable column 50 that interlocks with a lower stop 52 to enclose a middle stop 54 and an upper stop 56 that interact with a contact spring 58 and a return spring 60 to maintain the spanners 28, 30 in their respective positions and orientations illustrated in FIG. 1 (see also FIG. 5). The column 50 and the stops 52, 54, 56 preferably comprise a plastic or other nonconductive material(s). The column 50 also includes a plunger 62 that forms the uppermost portion of the column and that extends beyond an upper wall 64 of the housing 22 when not mechanically engaged with a switch operator. While FIG. 1 depicts terminals extending outwardly from the housing, any known manner of connecting the normally closed contact 24 and normally open contact 26 in series in accordance with the schematic representation of FIG. 2 may be used.

Referring again to FIGS. 1 and 5, when the switch 20 is not mounted onto a switch operator, the spanner 28 rests between contacts 36 and stop 56, and spanner 30 rests between stop 52 and stop 54. Contact spring 58, disposed within the column 50, rests between stops 54, 56, thereby biasing the spanners 28, 30 towards respective contacts 36, 38 on leads 40, 42, retaining the normally closed contact 24 in the closed position. Return spring 60 is sandwiched between a bottom wall 66 of the housing 22 and the bottom of stop 52. Because the return spring force is greater than the contact spring force, the return spring 60 biases the stop 52 upwardly until the spanner 30, sandwiched between stops 52, 54, is forced away from lead 42 into its normally open position. The force of the return spring 60 also biases the column 50 upwardly so that the plunger 62 is in a normal position, extending slightly beyond the upper wall 64 of the housing 22. The stops 52, 54, 56 and bottom wall 66 may contain small generally cylindrical nubs (not shown) having a diameter slightly smaller than the diameter of the spring 58 or 60 to which they connect to prevent the springs 58, 60 from sliding when installed.

Figure 5:
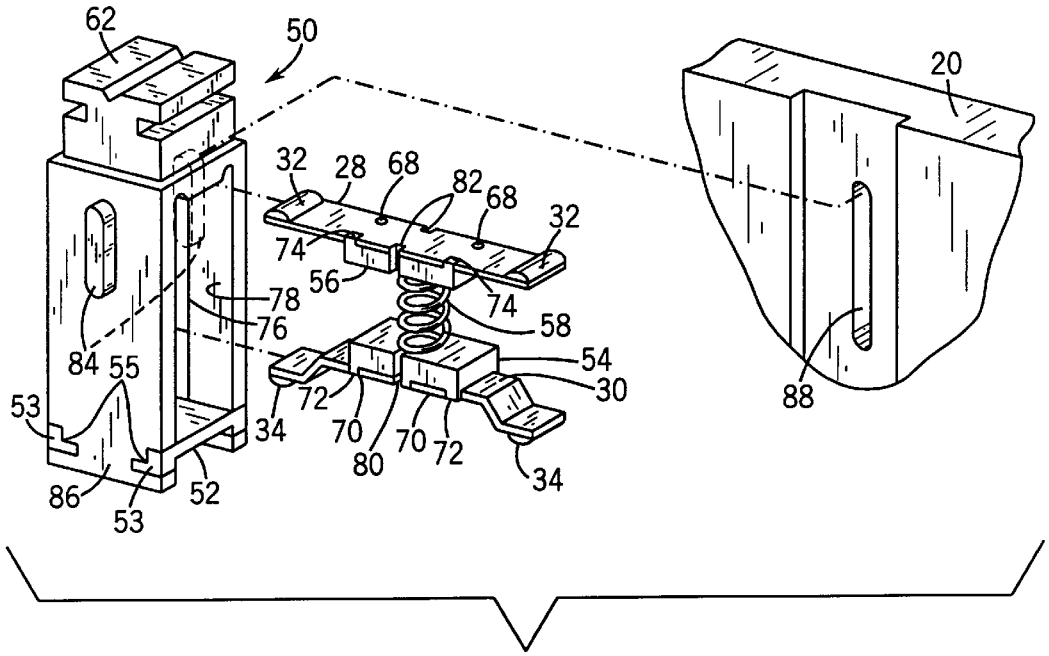
FIG. 5 is an exploded perspective assembly view of a portion of the switch assembly.

Referring now to FIG. 5, the spanners 28, 30 contain respective notches 68, 70 that engage respective protrusions 72, 74 on the stops 54, 56 to prevent slippage of the spanners with respect to the stops. Stop 52 contains projections 53 that engage cutout portions 55 in the column 50 to retain the stop 52 in place. Additionally, the column 50 contains a longitudinal protrusion 76 on each inside wall 78 that engages respective notches 80, 82 in stops 54, 56 to guide the spanners and stops and prevent twisting or binding. The column 50 also comprises a protrusion 84 on the exterior of outer wall 86 that mates with a slot 88 within the housing 22. The interaction between the protrusion 84 and slot 88 ensures proper movement of the column 50 within the housing 22 during operation, and also ensures that the column is not pushed out of the housing by the return spring 60.

Figure 4:
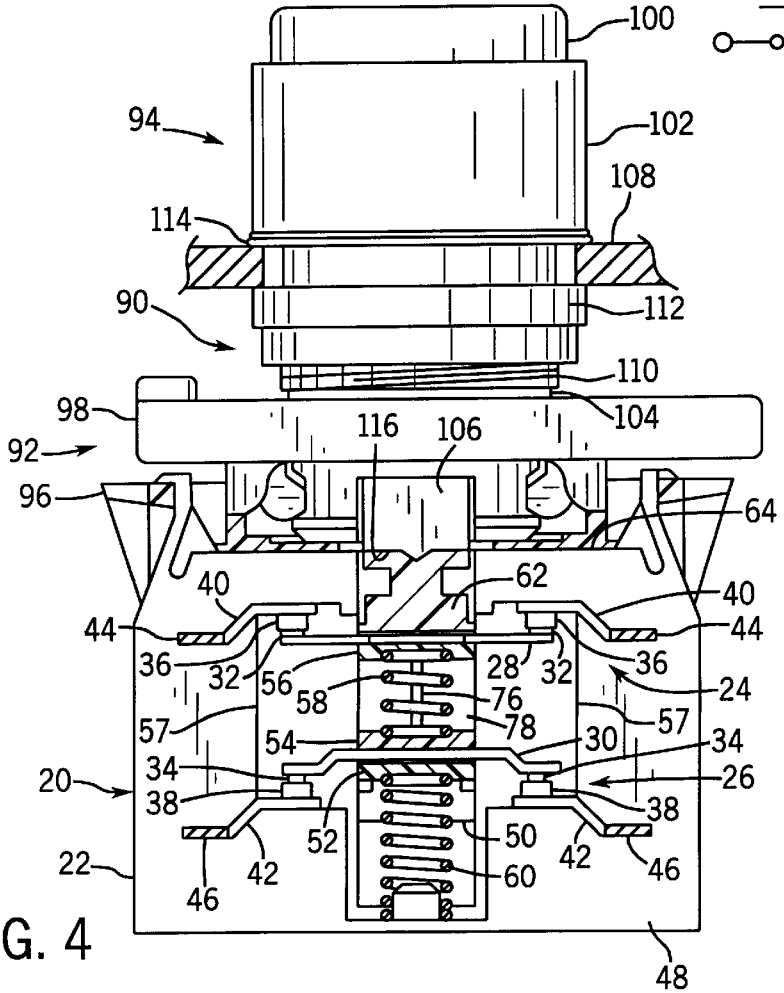
FIG. 4 is a partially cutaway side elevation view of the switch assembly of FIG. 3.

As a result of this construction, when the switch 20 is mechanically disengaged from a switch operator, spanner 28, in conjunction with contact spring 58, ensures that contact 24 is normally closed, and spanner 30, in conjunction with return spring 60, ensures that the contact 26 is normally open and that the plunger 62 is in a normal position extending outside the upper wall 64 of the housing 22 as shown in FIG. 1 and 4.

Figure 2:
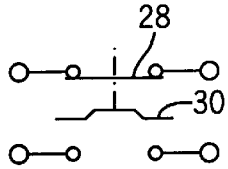
FIG. 2 is an electrical representation of the switch of FIG. 1.

FIG. 2 is a schematic electrical representation of the switch of FIG. 1, and shows normally closed spanner 28 in a closed position, and normally open spanner 30 in an open position when the switch 20 is mechanically disengaged from a switch operator. When the normally open spanner 30 closes, the circuit becomes closed, thereby rendering the controlled function operational, as will now be described.

Figure 3:
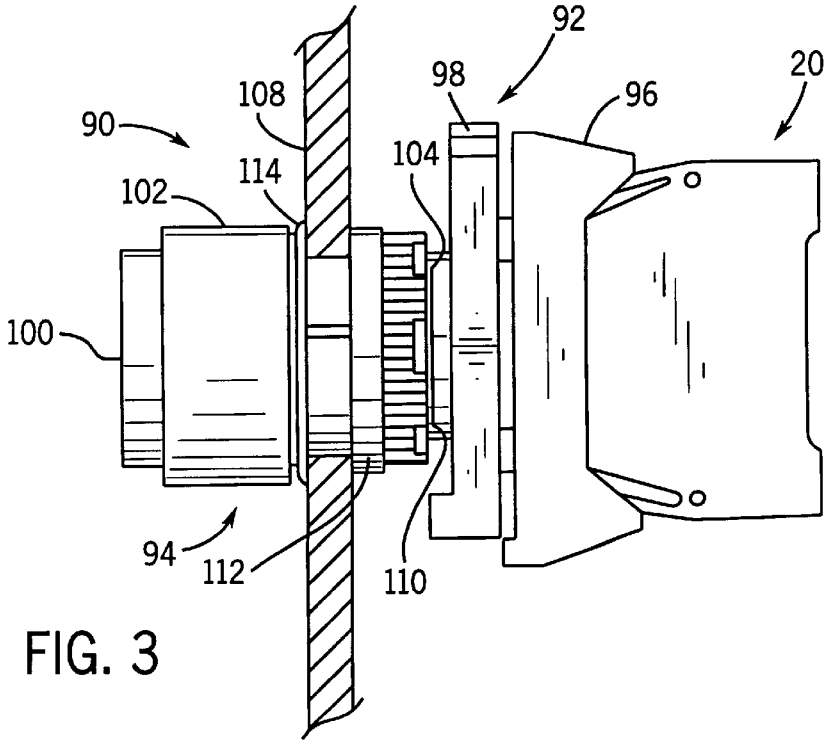
FIG. 3 is a side elevation view of a switch assembly incorporating the switch of FIG. 1.

Referring now to FIGS. 3 and 4, a switch assembly 90 is shown that comprises the switch 20 and that is mounted onto a latch assembly 92 via tabs, screws, or in any other known manner. The latch assembly 92 is then mounted onto a switch operator 94. While latch assembly 92 is shown in FIGS. 3 and 4 to comprise a housing 96 and collar 98, the latch assembly could include any apparatus that may be used to mechanically connect a contact block with a switch operator.

The switch operator 94 includes a pushbutton 100 located at a head 102 at one end of a cylindrical shaft 104. The pushbutton 100 attaches to a stem 106 passing generally inside the shaft 104 to communicate the action of the pushbutton to the plunger 62. A sheet panel 108, preferably made of sheet metal, has a hole (not shown) for receiving the shaft 104. External threads 110 are formed on the portion of the shaft 104 passing through the hole. The head 102, remaining on the outside of the panel 108 when the shaft 104 is inserted into the hole, is drawn against the panel by a retaining nut 112, placed over the shaft inside of the panel and tightened on the threads 110. The panel 108 is thus sandwiched between the nut 112 and an inner face of the head 102. An elastomeric washer 114 may also be positioned between the head 102 and the panel 108 on the outside of the panel to provide a seal against the outside environment. While an electrical switch operator comprising a pushbutton has been described, it should be noted that any type of switch operator may be used. For example, another type of operator sold by the assignee under the NEMA designation comprises a shaft and actuator that is inserted from behind a panel, and a threaded mounting ring is inserted onto the shaft and secured in the front of the panel.

Once the switch 20 is mechanically connected to the switch operator, the normally open contact 26 is in mechanical communication with the operator. Specifically, the operator stem 106 forces the plunger 62 and column 50 into a first depressed position against the force of the return spring 60, wherein upper surface 116 of the plunger is generally flush with upper wall 64 of the housing 22. The contact spring 58 biases the stop 54 downwardly and presses the spanner 30 against the lead 42, thereby closing the circuit when the terminals and the controlled function are electrically connected. As a result, when the switch 20 is mechanically connected to the switch operator 94, both the normally closed contact 24 and normally open contact 26 are closed, thereby permitting the normal operation of the function controlled by the normally closed contact 24, as will now be described. The normally closed contact 24 could be employed for many functions that require a cessation of a given function. One example is an E-Stop. While the normally closed contact 24 is not limited to an E-Stop, it will be referred to as such for the sake of simplicity throughout this disclosure.

Figure 6:
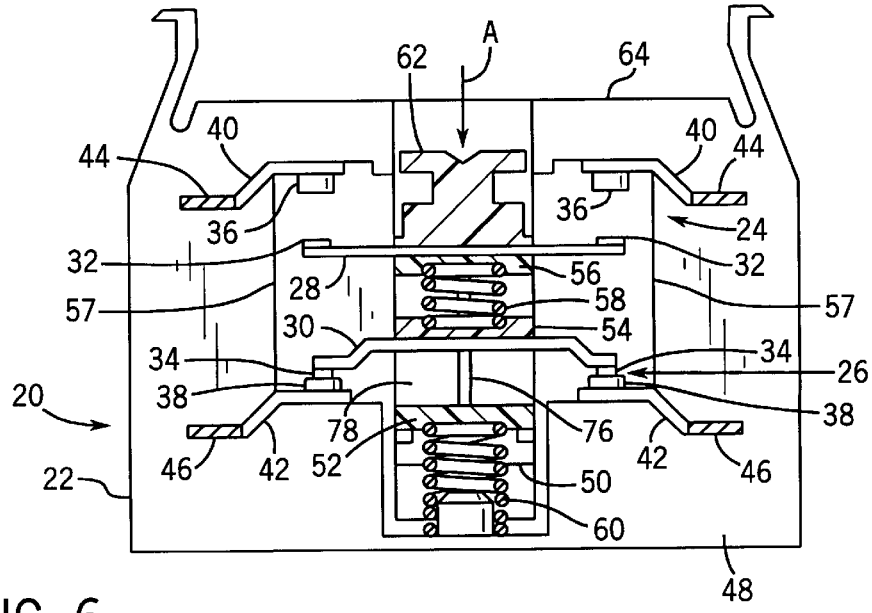
FIG. 6 is a sectional side elevation view of the switch assembly of FIG. 3, showing the switch of the assembly with its pushbutton depressed.

Referring now to FIG. 6, the normally closed contact 24 is also in mechanical communication with the switch operator. Specifically, when the pushbutton 100 is depressed, the pushbutton stem 106 forces the plunger 62 in the direction of arrow A and towards a second depressed position. As this occurs, the upper surface 118 of the column 50 biases the spanner 28 away from the contacts 36, thereby opening the normally closed contact 24 and opening the circuit. Because the contact spring 58 is compressed, it continues to press the normally open spanner 30 against the contacts 38. The controlled function is thereby terminated by the activation of the pushbutton 100. When the pushbutton 100 is released, the stem 106 raises upwardly under the force of a spring (not shown) within the switch operator 94, and the return spring 60 biases the column 50 upwardly such that the plunger 62 is returned to its normal extended position. The contact spring 58 biases spanner 28 toward contacts 36, thereby closing the contact 24 and resuming operation of the function.

In operation, the normally closed contact 24 and normally open contact 26 are both closed when the housing is mechanically connected to switch operator 94. When the contacts 24, 26 are electrically connected to a machine performing the controlled function, the function is fully operational until either the switch operator 94 is actuated, or the latch assembly becomes detached from the operator. The normally open contact 26 opens at this time, thereby cutting off current to the machine performing the controlled function. The function will then cease to operate, which will alert the user of a malfunction. The overall reliability is thereby increased and, because the E-Stop will no longer need to be tested to ensure operability, the efficiency of the controlled function is also increased.

Figure 7:
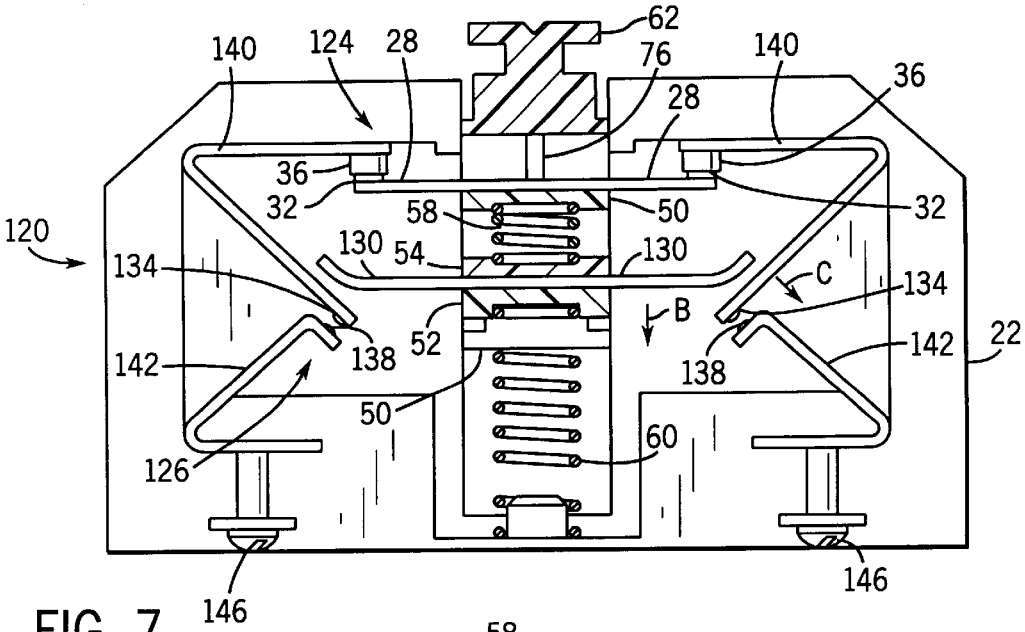
FIG. 7 is a sectional side elevation view of a switch constructed in accordance with an alternate embodiment of the present invention.
Figure 8:
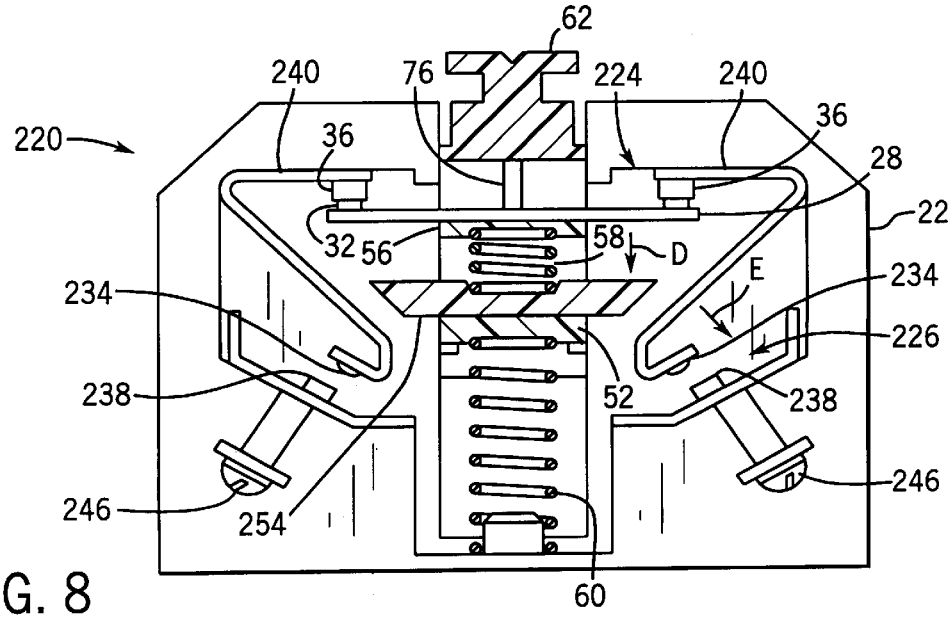
FIG. 8 is a side elevation view of a switch constructed in accordance with a second alternate embodiment of the present invention.

FIGS. 7 and 8 show switches 120, 220 as having different contact configurations. In these Figures, for the sake of simplicity, those reference numerals that are incremented by 100 identify elements corresponding to similar elements in FIGS. 16, but having different structure. The reference numerals corresponding to the other elements have remained unchanged.

In FIG. 7, switch 120 comprises a spanner 130 that is sandwiched between stops 52 and 54. When the housing 22 is mechanically disengaged from a switch operator (not shown), normally closed contact 124 is closed, as described above, and stop 52 ensures that spanner 130 is disconnected from lead 140. As described above, when the housing 22 mechanically engages the switch operator, the plunger 62 becomes depressed to its first position. Stop 54 then biases spanner 130 downwards in the direction of arrow B. Angled ends of spanner 130 then contact mating angled ends of leads 140 and bias the contacts 134 on the leads toward contacts 138 in the direction of arrow C. Contacts 138 are located adjacent ends of leads 142, which terminate in terminals 146. As a result, when the plunger 62 is in its first depressed position, and when terminals 146 are electrically connected to the machine performing the controlled function, a closed circuit comprises terminals 146, lead 142, lead 140, and spanner 28. The user therefore need not manually electrically connect normally open contact 126 to normally closed contact 124, as this circuit is automatically completed when the plunger 62 is depressed.

Figure 7A:
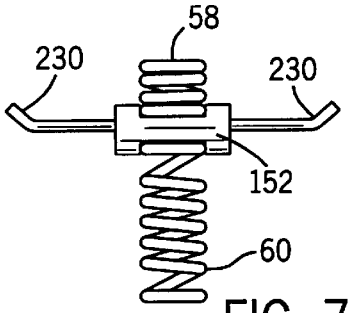
FIG. 7A is an alternate embodiment of a portion of the normally open contact of FIG. 7.

Spanner 130 preferably comprises a nonconductive material(s) in this embodiment to prevent open contact 26 from being in parallel electrical connection with closed contact 124. (Alternatively, as shown in FIG. 7A, a conductive spanner 230 could be mounted onto both sides of nonconductive stop 152 such that the opposite sides of the spanner would be insulated from each other by the stop.) Leads 140 comprise an elastic conductive material such that, when the plunger 62 returns to the normal extended position, the leads return to the position shown in FIG. 7, whereby they are disconnected form contacts 138. Additionally, as described above, when the plunger 62 is further depressed (e.g. upon activation of an operator), spanner 28 is biased away from contacts 36, thereby opening the circuit.

In FIG. 8, the switch 220 comprises a normally closed contact 224 and normally open contact 226. Spanner 28 is opened and closed as described above. When plunger 62 is depressed to the first position, a stop 254 is moved downwardly in the direction of arrow D and moves contacts 234 in the direction or arrow E until contacts 234 contact contacts 238. Contacts 238 are located on leads 234, which terminate in terminals 246. When the housing 22 is mechanically connected to a switch operator, and when terminals 246 are electrically connected to a controlled function, the closed circuit comprises terminals, 246, leads 242, leads 240, and spanner 28. Leads 240 are preferably formed from a conductive elastic material(s) such that, when plunger 62 is returned to its normal extended position, thereby removing stop 254 from lead 240, the lead returns to the open position shown in FIG. 8.

Alternatively, a spring could be inserted into housing 22 that bias leads 140, 240 into the normally open position. In this arrangement, depressing the plunger and moving the leads 140, 240 in the directions of arrows C and D, respectively, would compress the springs 58, 60 and close the normally open contacts 126, 226 as described above.

Figure 9:
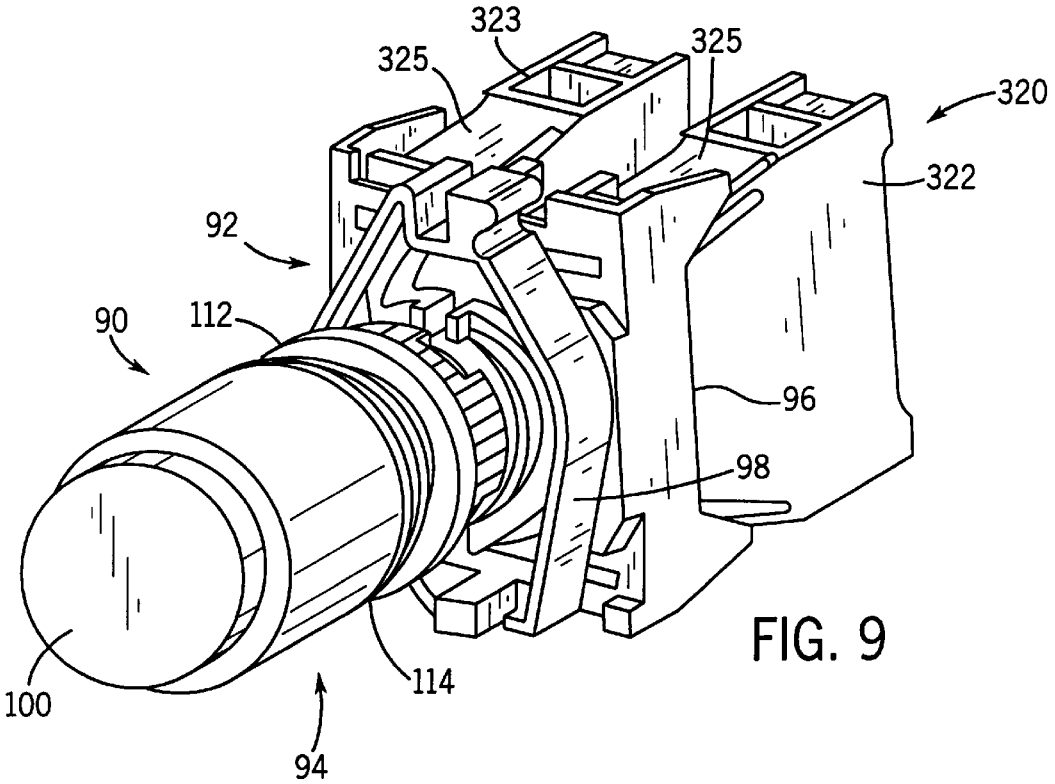
FIG. 9 is a perspective view of a switch assembly constructed in accordance with the invention and including multiple housings.
Figure 10:
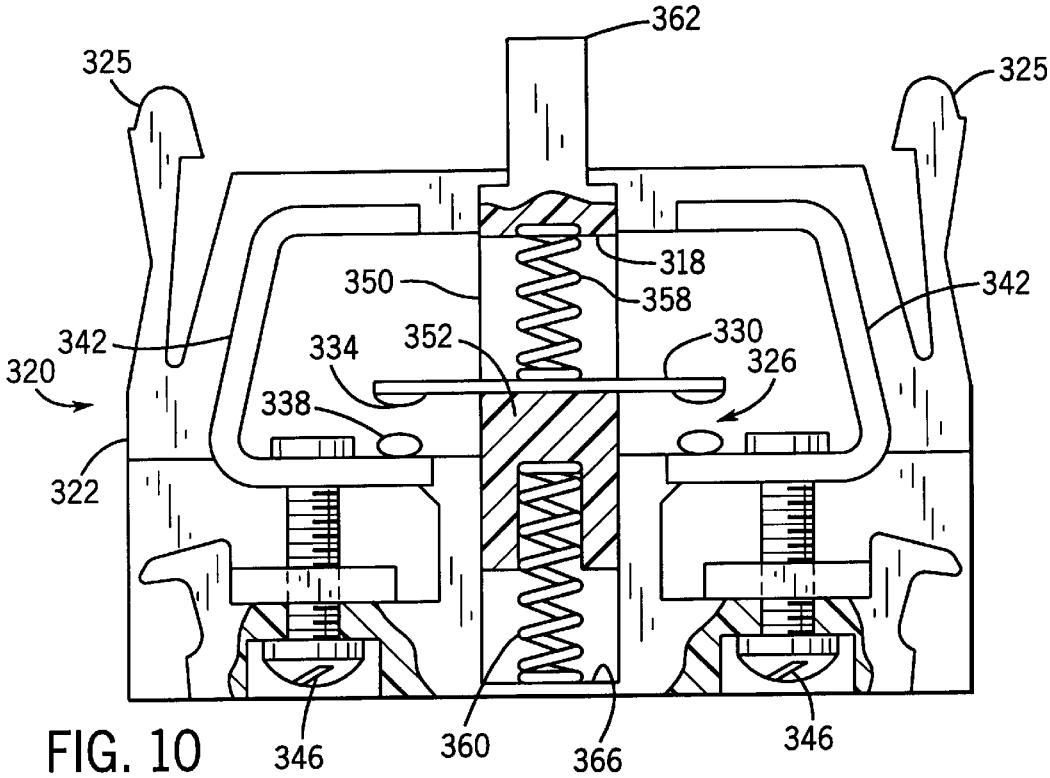
FIG. 10 is a sectional side elevation view of a housing of FIG. 9 having a normally open contact.
Figure 11:
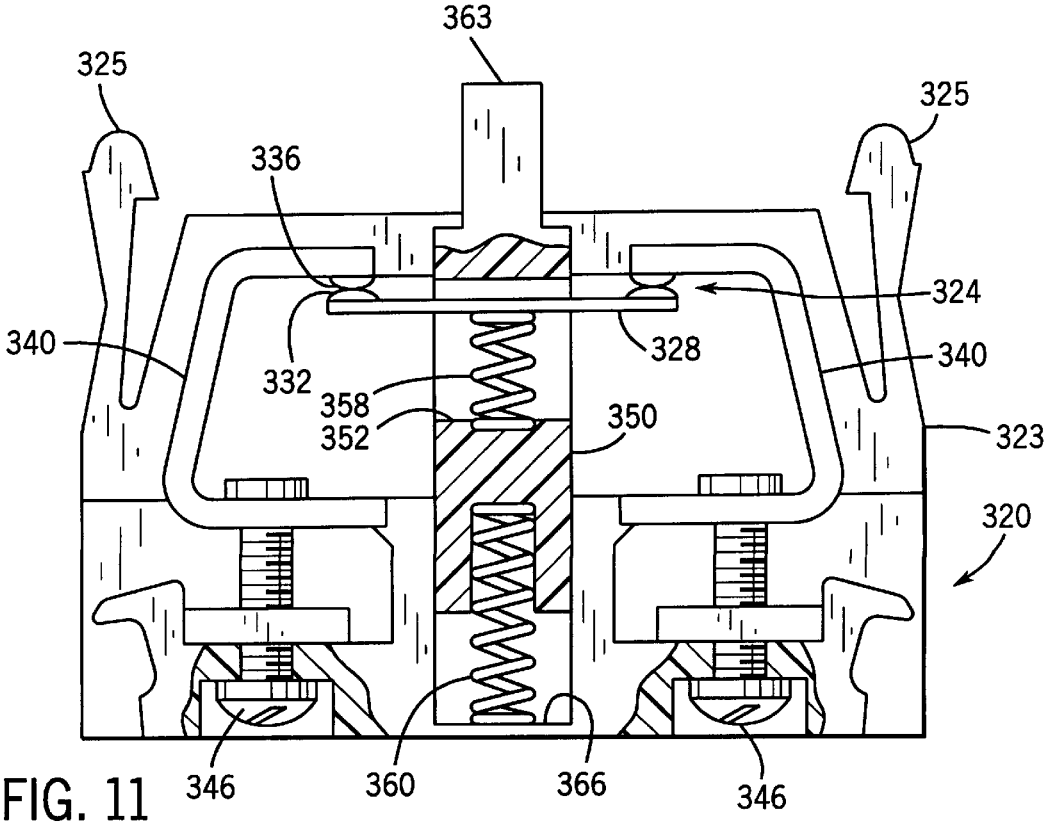
FIG. 11 is a sectional side elevation view of a housing of FIG. 9 having a normally closed contact.

In another embodiment, as shown in FIGS. 9–11, switch 320 comprises a normally open contact 326 within housing 322, while normally closed contact 324 is disposed within a separate housing 323. The reference numerals in these Figures are incremented by an additional 100 to indicate elements corresponding to those elements in FIGS. 1–8. Because housing 322 employs several common elements with housing 323, the reference numerals pertaining to those elements are the same.

In this embodiment, both housings 322, 323 are mounted onto latch assembly 92 via tabs 325 or in any other known manner, thereby retaining the housings in mechanical communication with one another.

In the housing 322, contact spring 358 is disposed within a column 350 between an upper surface 318 of the column 350 and a spanner 330. The spanner 330 is disposed between contact spring 358 and stop 352. Stop 352 may either be an integral part of the column 350, or a removable stop that fits into place within the column. A return spring 360 rests against bottom wall 366 of the housing 322 at one end and the stop 352 at the other end. When the latch assembly 92 is mechanically disengaged from the switch operator 94, the return spring 360, having a greater force than contact spring 358, biases the stop 352 upwards into an open position away from contacts 338, and moves the plunger 362 to a normal extended position outside the housing 322. When the housing 322 is mechanically connected to the switch operator 94, the operator stem 106 biases the plunger 362 downwardly to a first depressed position until the stop 352 compresses the return spring 360, and the contact spring 358 biases the spanner 330 towards contacts 338 on lead 342, thereby closing the normally open contact 326. When the pushbutton 100 is actuated, the plunger 362 is depressed to a second position, thereby further compressing springs 358, 360, which serve only to retain spanner 330 in a closed position against contacts 338. As a result, contact 326 will only open when it becomes mechanically disengaged from the switch operator 94.

In the housing 323, contact spring 358 is disposed within the column 350 between stop 352 and a spanner 328. The spanner 328 is disposed between contact spring 358 and upper surface 318 of column 350. Stop 352 may either be an integral part of the column 350, or a removable stop that fits into place within the column. A return spring 360 rests against bottom wall 366 of the housing 323 at one end and the stop 352 at the other end. A contact spring 358 rests against stop 352 at one end and normally closed spanner 328 at its other end. The return spring 360 and contact spring 358 interact to press the spanner 328 against contacts 336 on lead 340, and to force the plunger 363 upward and away from the housing 323. When the latch assembly 92 is not connected to an operator, return spring 360 biases stop 352 upwardly towards the contact spring 358, thereby biasing the spanner 328 towards contacts 336, and maintaining the normally closed contact 324 in the closed position.

When the latch assembly 92 is mounted onto switch operator 94, the operator stem 106 biases the plunger 362 downwardly to close the contact 326. In order to prevent the stem from interfering with the plunger 363 and opening the contact 324, plunger 363 is shown shorter than plunger 362. As a result, when the latch assembly 92 is mounted to the operator 94, the stem 106 will bias plunger 362 downwards such that both plungers 362, 363 will extend approximately the same distance from the housings 322, 323. Therefore, the plunger 362 in its first depressed position extends outside housing 322 the same distance that plunger 363 extends outside of housing 323. As a result, when the switch operator 94 is actuated, plunger 363 is depressed, thereby biasing the upper surface 318 of the column 350 against the spanner 328 in a direction away from contact 328, and opening the normally closed contact 324. Alternatively, upper surface 318 could be located further upwards from spanner 328, thereby forming a gap between the upper surface and the spanner. This would allow the gap to close when the upper surface 318 is biased towards spanner 328 when the latch assembly 92 is mounted onto the switch operator 94.

As a result, when terminals 346 of the housings 322, 323 are electrically connected in series by one of any known techniques, and the latch assembly 92 is mounted onto switch operator 94, the controlled function becomes operational. The function is then halted when either the pushbutton 100 is actuated, thereby opening the normally closed contact 324, or when the latch assembly 92 becomes mechanically disengaged from the switch operator 94, thereby also mechanically disengaging the normally open contact 326 from the operator and opening the normally open contact.

Additional contact blocks may also be connected to the configuration of FIG. 9 in accordance with an embodiment of this invention so long as they are connected in series with the switch 320 and mechanically connected to the switch operator 94, via latch assembly 92, such that the normally open contact 326 opens when the added contact block is mechanically disengaged from the operator 322, 323. While the housings are described as being connected to the switch operator 94 via a latch assembly 92, the switch and monitored contact may be implemented via any known manner of connecting the contact blocks in tandem to a switch operator.

Alternatively, if a user is concerned with the possibility of a contact block becoming detached from the latch assembly 92, the switch 320 could be mounted onto the housing of the contact block to be monitored in a side-by-side orientation such that the switch would mechanically disengage the switch operator if the added contact block becomes mechanically disengaged, thereby opening the normally open contact and terminating the controlled function, as described above.

Many changes and modifications may also be made to the invention without departing from the spirit thereof. The scope of these changes will become apparent from the appended claims.

We claim:

1. A switch assembly for monitoring a control function comprising:

a switch operator;

a normally closed set of contacts disposed within said housing; and a normally open set of contacts electrically connected to said normally closed set of contacts:

a housing interfitting with said switch operator and supporting said normally open and normally closed sets of contacts; and a linkage at least partially supported within the housing and configured to open said normally open set of contacts when the housing becomes mechanically disconnected from the switch operator.

2. The switch of claim 1, wherein said normally open set of contacts is electrically connected in series with said normally closed set of contacts.

3. The switch of claim 2, wherein said normally closed set of contacts is electrically connected to a machine performing a controlled function, and wherein said electrical connection is disrupted when said normally open set of contacts is open.

4. The switch of claim 1, wherein the linkage comprises:

a plunger at least partially disposed in said housing; and a spring mechanism in mechanical communication with said plunger and with said normally open set of contacts, wherein said normally open set of contacts is open when said plunger is in a normal position.

5. The switch of claim 4, wherein bringing said switch operator into contact with said plunger depresses said plunger from said normal position to a first position, thereby biasing said spring mechanism towards said normally open set of contacts so as to close the normally open set of contacts.

6. The switch of claim 5, wherein actuating the switch operator depresses said plunger to a second position, thereby opening said normally closed set of contacts.

7. The switch of claim 1, wherein said housing comprises a first housing and said normally open set of contacts is disposed in a second housing that is in mechanical communication with said first housing.

8. The switch of claim 7, wherein said normally open set of contacts is electrically connected in series to establish an electrical connection with said normally closed set of contacts and with a control circuit.

9. The switch of claim 8, wherein said normally open set of contacts opens the electrical connection in the control circuit when said first housing becomes mechanically disconnected from the switch operator.

10. The switch of claim 9, wherein the linkage includes a plunger that is at least partially disposed in said second housing and is in mechanical communication with the switch operator at one end, and with a spring mechanism at a second end, wherein said spring mechanism is in mechanical communication with said normally open set of contacts, and wherein the switch operator biases the plunger towards the normally open set of contacts so as to close the normally open set of contacts.

11. The switch of claim 9, wherein actuating the switch operator further biases said plunger towards said normally open set of contacts and opens said normally open set of contacts.

12. A method of monitoring a control circuit comprising:

electrically connecting a normally open set of contacts to a normally closed set of contacts; and placing said normally open set of contacts and said normally closed set of contacts in mechanical communication with a switch operator and each other. wherein said switch operator is closes said normally open set of contacts during said placing step, and wherein disengaging said normally closed set of contacts from the switch operator disengages said normally open set of contacts from said switch operator so as to open said normally open set of contacts.

13. The method of claim 12, further comprising placing said normally open set of contacts and said normally closed set of contacts within a housing, and mechanically connecting said housing to a switch operator.

14. The method of claim 13, further comprising attaching a plunger to said housing, wherein said mechanically connecting step further comprises depressing said plunger from a relaxed position to a first position to close said normally open set of contacts.

15. The method of claim 14, further comprising mechanically disconnecting said housing from the switch operator and returning said plunger to said normal position after said mechanically disconnecting step.

16. The method of claim 14, further comprising:

actuating the switch operator; and further depressing said plunger to a second position to open said normally closed set of contacts.

17. The method of claim 12, further comprising:

inserting said normally open set of contacts in a first housing; and inserting said normally closed set of contacts in a second housing in mechanical communication with said first housing; and mechanically connecting said first housing and said second housing to the switch operator.

18. The method of claim 17, further comprising attaching a plunger to said first housing, wherein the step of mechanically connecting said first housing to the switch operator depresses said plunger from a normal position to a first position to close said normally open set of contacts.

19. The method of claim 18, further comprising:

mechanically disengaging said first housing from the switch operator; and automatically returning said plunger to said normal position upon said mechanical disengaging step to open said normally open set of contacts.

20. The method of claim 18, further comprising actuating the switch operator to depress said plunger to a second position, thereby opening said normally closed set of contacts.

21. A switch assembly for monitoring a control circuit comprising:

a housing mechanically connected to a switch operator;

a normally closed set of contacts disposed within said housing;

a normally open set of contacts electrically connected to said normally closed set of contacts and disposed within said housing; and a plunger at least partially disposed within said housing an in mechanical communication with said normally open set of contacts, wherein said plunger is depressed from a normal position to a depressed position, and wherein said plunger closes said normally open set of contacts when in the depressed position thereof whenever said housing is connected to the switch operator so as to place said plunger and operator in mechanical communication, and wherein said plunger returns to said normal position and opens said normally open set of contacts whenever said housing becomes mechanically disconnected from the switch operator.

22. A switch for monitoring a control circuit comprising:

a first housing connected to a switch operator;

a normally closed set of contacts disposed within said first housing;

a second housing connected to said switch operator;

a normally open set of contacts disposed within said second housing and electrically connected to said normally closed set of contacts; and a plunger at least partially disposed within said second housing, wherein said plunger is depressed from a normal position to a depressed position and closes said normally open set of contacts whenever said second housing is mechanically connected to said switch operator so as to place said plunger and operator in mechanical communication, and wherein said plunger returns to said normal position and opens said normally open set of contacts whenever said housing becomes mechanically disconnected from said switch operator.

* * * * *